US005741091A

United States Patent [19]

St. George et al.

[11] Patent Number: 5,741,091

[45] Date of Patent: Apr. 21, 1998

[54] SHORING DEVICE WITH LOAD OPTIONAL ENHANCING SPREADERS

[75] Inventors: Gregory L. St. George, Tempe; Charles B. Jennings, Phoenix, both of Ariz.

[73] Assignee: Safe-T-Shore, Tempe, Ariz.

[21] Appl. No.: 596,583

[22] Filed: Feb. 5, 1996

[51] Int. Cl.[6] ..... E02D 3/02; E02D 5/00

[52] U.S. Cl. ..... 405/283; 405/282

[58] Field of Search ..... 405/283, 282, 405/272, 273

[56] References Cited

U.S. PATENT DOCUMENTS

| | | | |
|---|---|---|---|
| 2,908,140 | 10/1959 | Everson | 405/283 |
| 3,750,409 | 8/1973 | Orfei | 405/283 |
| 3,820,345 | 6/1974 | Brecht | 405/283 |
| 4,058,983 | 11/1977 | Griswold | 405/283 |
| 5,310,290 | 5/1994 | Spencer | 405/283 |

*Primary Examiner*—Dennis L. Taylor
*Attorney, Agent, or Firm*—Gregory J. Nelson

[57] ABSTRACT

A shoring device for supporting trench side walls during construction. The shoring device has opposite shoring shields having conventionally located spreaders adjacent the upper edge of the shields and a second pair of spreaders disposed at an upper location. A pair of auxiliary spreaders are associated with the shield assembly. Each auxiliary spreader member consists of a structural member having connectors at opposite ends which are detachably securable to the interior walls of the shields at a location below the horizontal center line of the shields to substantially increase the shield capacity. The auxiliary spreaders would be used primarily when the maximum pipe clearance is not required to achieve a greater load factor.

3 Claims, 1 Drawing Sheet

10
20
56
40
52
58
59
63
60
65
66
64
125
100
24
14
28
25
12

112
116
130
108
106
104
114
110
150
152
140
142
145
146
160

52
40
54
28
58
63
60
62
64
65
100
A
B 28
34
40
42
38
60
26
25
39
100
24
36
30

SHORING DEVICE WITH LOAD OPTIONAL ENHANCING SPREADERS

BACKGROUND OF THE INVENTION

Field of the Invention

The present relates to a shoring device and more particularly to the type of shoring device which is known as a trench shield and is used to support the walls of an excavation such or trench during construction.

Sound construction safety practice and federal standards such as OSHA as well as many local standards for safe trenching practices require that the sidewalls of trenches below a specified depth be supported or shored against collapse. The particular shoring requirements vary with soil composition and trench width and depth. Generally with stable soils, state and federal regulations require trenches having a depth greater than approximately 4 to 5 feet be vertically shored to avoid exposing underground workers to the hazards of an unshored trench.

When excavating unstable soils, additional safety precautions may be necessary. For small excavations, utility repair pits and shallow trenches, single wall trench boxes may be adequate. However for deeper trenches and in unstable soils, heavier duty, double wall trench shields may be required to be utilized.

Conventionally trench shields generally are of single or double wall construction and maintained apart in spaced vertical relationship by spreaders. Typically, lighter duty trench shields utilize five inch schedule 40 pipe as spreaders. Higher duty trench shields utilize heavier spreaders such as spreaders fabricated from 8 inch schedule 80 pipes and such trench shields may be provided in incremental sizes having heights of 4, 6, 8 and 10 feet and may weigh as much as 10,000 pounds. Depending on the design of the trench shield, 4 or 6 spreaders are typically used to laterally support the shields. If, for example, 4 spreaders are utilized, the upper spreaders are located at the upper corners of the shield walls and the lower spreaders are located generally at least at or above the vertical mid point of the opposed wall. A pair of intermediate spreaders may be provided at the edge of the walls between the top and bottom spreaders. Appropriate lifting lugs or lifting eyes for easy safe installation are generally provided as part of the shield assembly.

The positioning of the spreaders is selected to provide maximum pipe clearance so that workers with in the trench do not encounter interference between pipe being laid in the trench and the lower spreaders. However positioning the spreaders to obtain maximum or highest pipe clearance results in a trench box or trench shield having reduced or lowered capacity. Accordingly, when working with smaller diameter pipe, and maximum or highest pipe clearance is not required, the contractor must nevertheless use a heavy duty shield in order to obtain the necessary shield capacity in pounds per square foot (PSF) rating.

In view of the foregoing, there exists a need in the trenching industry for a versatile trench shield which will provide increased shield capacity when maximum pipe clearance is not required allowing the contractor to use a lighter duty shield. There also exists a need for a trench shield which is adaptable to permit selective positioning of the spreaders to increase or decrease the shield capacity.

SUMMARY OF THE INVENTION

Briefly the present invention provides an improved shoring device or trench shield having a pair of oppositely disposed walls which are generally rectangular and may be single or double wall construction. A first pair of spreaders are located near the upper edge of the walls. A second pair of spreaders extend between the shield walls disposed below the upper spreaders and located at an elevation spaced from the upper edge of the shield walls of about one-third the overall height of shields. The load factor or capacity of the trench shield is increased by providing an additional set of load enhancing spreaders extending between the opposite shield walls at an elevation at approximately at or slightly below the horizontal center line of the shield walls. The additional spreaders substantially enhance or increase the load factor and are detachably secured to pads welded to the interior surface of the shields.

The additional load enhancing spreaders consists of a tubular structural member having opposite ends which are received in cylindrical collars and secured by retaining pin. The collars are secured to plates which have bores which align with tapped holes in pads welded to the trench shield walls. When maximum pipe clearance is not necessary and increased load capacity is desired, the load enhancing spreaders are positioned between the trench shield walls by securing the spreaders in place by using bolts to secure the mounting collars to the pads welded to the interior surface of the shield walls. The addition of the optional load enhancing spreaders extending across the lower portion of the trench shield assembly substantially adds to the overall capacity of the shield. It is estimated that such additional spreaders will increase the load factor by at least as much as 30%. If pipe clearance is a particular problem, the conventionally located first and second spreaders may be utilized and the load enhancing spreaders are eliminated and conventional load capacity rating is achieved with greater pipe clearance being available.

Accordingly, it is a broad object of the present invention to provide a trench shield having optional load enhancing spreaders which may be utilized in certain working conditions where maximum pipe clearance is not required to achieve greater capacity or load ratings.

BRIEF DESCRIPTION OF THE DRAWINGS

The above and other features and advantages of the present invention will become more apparent from the following description, claims and drawings in which:

Figures 1, 2, 3, 4:
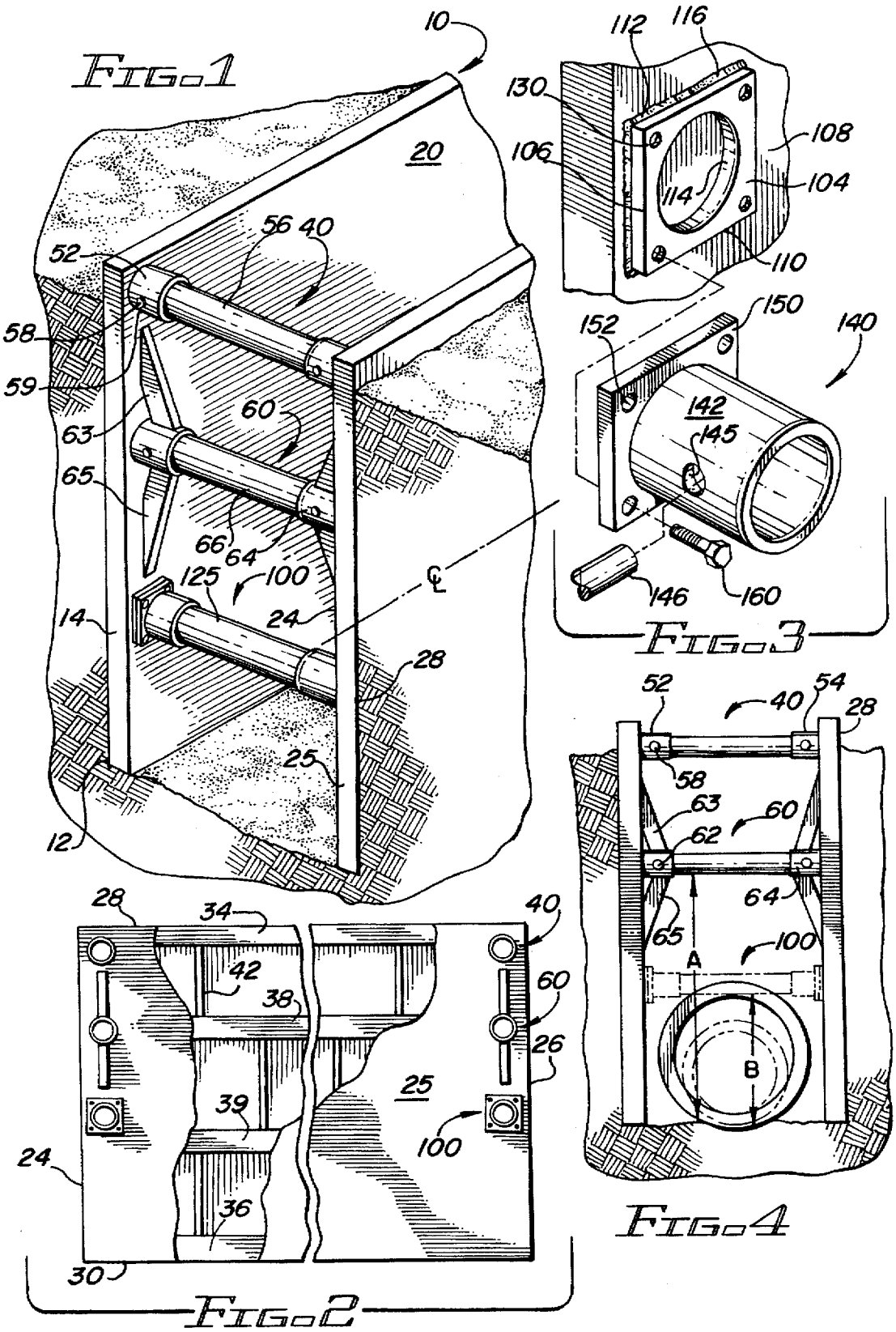
FIG. 1 is a perspective view of a portion of the trench shield of the present invention shown in position in a trench with the optional load enhancing spreaders in place.
FIG. 2 is an elevational view of an interior wall of one of the shield walls partly broken away to illustrate its construction.
FIG. 3 is an exploded detail view showing the connection of the optional load enhancing spreader to the interior of the shield wall.
FIG. 4 is an end view showing the trench shield of the present invention in position in a trench with a load enhancing spreader being shown in phantom lines and further showing several pipe diameters, the smaller of which would permit the non-interfering use of the load enhancing spreaders.

Turning now to the drawings, the trench shield device of the present invention is shown and generally indicated by the numeral 10. As indicated above, the shoring device is placed in a trench such as trench 12 when excavating soil when, for example, repairing utilities or laying pipe. The purpose of the shield is as a protection to personnel supporting the opposite side walls 14 and 16 of the excavation to reduce the possibility of collapse of the trench sidewalls during construction activities.

The shoring device of the present invention is generally designated by the numeral 10 and generally consists of opposed shoring walls 20 and 22. Each of the walls is shown as being generally rectangular having vertical side walls 24 and 26 top edge 28 and bottom edge 30. The shields have an inner surface 25 and an outer surface 28 both of which are shown as being generally planar. The shield walls may be of single wall construction or double wall construction and, in the present case, are shown in FIG. 2 as having double wall construction in which the inner and outer wall panels are reinforced by an interior frame work including a horizontal top beam 34 a horizontal lower beam 36 and horizontal intermediate beams 38 and 40. The beams are variously inter-connected by a plurality of ribs or stringers such as vertical ribs 42. The double wall reinforced construction provides greater strength and also allows the shields to be pounded into place in the trench. Generally the shields are provided in 4, 6, 8 and 10 foot heights and weigh in excess of 10,000 pounds. Typical shield capacity in pounds per square foot (PSF) ranges from approximately 1,000 PSF to 1,400 PSF for most conventional trench shields.

The trench shield walls 20 and 22 are supported in the trench 12 by a first pair of upper spreader assemblies 40 located in the opposite corners of the wails near the intersection of top edge 28 with sides 24 and 26. The first or upper spreader assemblies are secured by sockets 52 and 54 which are welded to the interior surfaces of the opposite shields 12 and 14 as seen in FIGS. 1 and 4. A tubular member 56 extends between the sockets 52 and 54 and typically would be a length of schedule 80 pipe having a diameter of from 4 to 6 inches secured by pin 58 extending through the socket in a bore in the pipe ends in registry by the socket bore 59.

A pair of second spreaders 60 are located below the uppermost spreaders and as seen in FIG. 1 and 2 are disposed adjacent the vertical sides 24 and 26 of the walls. In the case of a ten foot high trench box, the spreaders 60 are located to provide vertical clearance of about 90 inches from the spreaders 60 to the lower edge 30 of the trench shield walls. Spreaders 60 include a pair of opposed sockets 62 and 64 secured to the opposed interior surface of walls 12 and 14. A section of pipe 66 extends between the sockets and is held in place by a suitable returning pin 68. Truss like lifting lug members 63 and 65 may be provided and oppositely project from the exterior of the sockets to the interior walls of the shields to provide reinforcement and a convenient attachment location for a cable or chain.

The trench shield construction described to this point is more or less conventional and the conventional design allows maximum pipe clearance "A" as indicated in FIG. 4. As mentioned above, with a ten foot high trench shield the clearance "A" would be approximately 90 inches. However in many installations, substantially less pipe clearance is required. For example, if pipe clearance of only dimension "B" is indicated and FIG. 4 is required, an optional spreader according to the present invention may be secured between opposing shield walls thereby increasing the capacity of the shield substantially to allow the contractor to use a much lighter shield and obtain the equivalent capacity resulting in substantial savings.

The auxiliary or optional spreader of the present invention consists of an assembly 100 which is positioned adjacent opposite vertical edges 24 and 26 of the opposed shield walls at a location at or slightly below the horizontal center line (CL) of the shields as indicated in FIG. 1. The auxiliary spreaders 100 each consists of a pair of pads 104 secured to the interior surface 20 and 24 of the walls. The pads 104 are seen in FIG. 3 and each are generally rectangular fabricated of a suitable high tensile plate steel having opposite sides 106 and 108 and opposite edges 110 and 112. The plates define a generally circular cut out 114 corresponding to the exterior diameter tubular spreader member 125. The pads 104 are welded to the interior surface of the walls by weldment 116. Internally tapped or threaded bores 130 are provided in the pad in a regular pattern at the corners of the pad.

A connector 140 is detachably securable to each of the pads. Each of the connectors 140 consists of a generally cylindrical socket 142 having an interior diameter which corresponds to the diameter of the spreader pipe 125. The socket has a bore 145 which is adapted to register with a corresponding bore in the ends of the spreader pipe 125 so that a pin 146 may be inserted through the socket 142 into the spreader pipe 125.

The connector also includes a plate like-flange 150 which is generally rectangular and being dimensioned corresponding to the dimensions of the pad 104. The flange 150 has a bolt plurality of bolt holes 152 positioned to correspond in location of the threaded bores 130. The connector 140 may be detachably secured to the pads 104 by conventional bolts 160.

When maximum pipe clearance is not required and increased shield capacity is desired, the trench shields would be assembled with the upper most spreaders 40 in place. Spreaders 60 would be omitted and the auxiliary spreaders 100 would be positioned between the shield walls by securing the pads 104, connectors 140 and spreader pipes 125 in position adjacent the opposite vertical edges of the shields.

Since the auxiliary spreaders are located in the lower part of the trench shield assemblies, the auxiliary spreader pipes 125 are placed in compression and resist the inward force exerted by the trench side walls. The upper spreader pipes 56 are generally in tension in the working environment. It is estimated that by placing auxiliary spreaders in position as shown, shield capacity can be increased by as much as 25 to 30% allowing the contractor to use lighter weight less expensive shields which are also easier to handle lift and reposition in the trenches.

It will also be seen that the present invention provides a unique shoring device which is highly versatile and efficient. The device allows the contractor to selectively assemble the shield to achieve the pipe clearance and load factor required. When the maximum pipe clearance is in consideration, the shield assembly can be assembled as a conventional shield having the conventional load factor. If reduced pipe clearance is acceptable, the auxiliary spreader pipes located in the lower section of the shields can be put in position substantially increasing the load factor.

It will be obvious to those skilled in the art that various changes, alterations or modifications may be made to the invention described herein. To the extent these various changes alterations and modifications do not depart from spirit and scope of the appended claims, they are intended to by encompassed therein.

We claim:

1. A shoring device for shoring the side walls of a trench like excavation comprising:

(a) a pair of shield walls each having a generally planar soil engaging exterior surface and a generally planar interior surface, said walls having an upper edge, a lower edge and opposite generally vertical sides;

(b) a first pair of spreader members extending transversely between the opposite interior surfaces of the shield walls at a location adjacent their upper edges and adjacent the sides of the shield walls;

(c) a second pair of spreader members extending transversely between the opposite interior surfaces of the said shield walls at a location adjacent the sides of the shield walls and disposed below said first pair of spreader members, said second pair of spreader members being detachably securable to said shield walls;

(d) a pair of auxiliary spreader members being detachably secured between the interior surfaces of the opposite shield walls at a location generally below the horizontal center line of the shield walls whereby the auxiliary spreader members may be selectively secured in place independently of said second pair of spreader members to achieve greater load factor or removed to achieve increased clearance; and (e) said auxiliary spreader members each comprising:

(i) pads permanently secured to the interior shield walls at opposed locations having bores therein;

(ii) a spreader pipe having opposite ends;

(iii) a connector disposed at the opposite ends of said pipe, said connectors each including a generally cylindrical socket and a flange secured thereto, said flange defining bores alignable with said bores in said pads; and (iv) removable fastener means engageable in said bores for securing said connectors to said pads.

2. The shoring device of claim 1 wherein said shield walls are single wall construction.

3. The shoring device of claim 1 wherein said shield walls are double wall construction.

* * * * *